US005636735A

United States Patent [19]

Stusek

[11] Patent Number: 5,636,735

[45] Date of Patent: Jun. 10, 1997

[54] GOLF BAG SECURITY DEVICE

[75] Inventor: Richard A. Stusek, Bloomfield Hills, Mich.

[73] Assignee: Kinetic Concepts, Inc, Bloomfield Hills, Mich.

[21] Appl. No.: 659,358

[22] Filed: Jun. 6, 1996

[51] Int. Cl.[6] ..... A63B 55/00

[52] U.S. Cl. ..... 206/315.6; 206/315.2; 206/315.3

[58] Field of Search ..... 206/315.2–315.6

[56] References Cited

U.S. PATENT DOCUMENTS

| | | | |
|---|---|---|---|
| D. 336,603 | 6/1993 | Penaflor . | |
| 1,717,959 | 6/1929 | Cauffman | 206/315.6 |
| 1,731,588 | 10/1929 | Patterson | 206/315.6 |
| 4,245,684 | 1/1981 | Street et al. | 206/315.4 |
| 4,538,728 | 9/1985 | Lewis | 206/315.3 |
| 4,860,889 | 8/1989 | Lemieux et al. | 206/315.6 |
| 4,863,019 | 9/1989 | Lewis et al. | 206/315.3 |
| 5,004,100 | 4/1991 | Smith | 206/315.2 |
| 5,028,909 | 7/1991 | Miller | 206/315.3 X |
| 5,041,815 | 8/1991 | Newton | 340/568 |
| 5,524,753 | 6/1996 | Murphy | 206/315.6 |

FOREIGN PATENT DOCUMENTS

| | | | |
|---|---|---|---|
| 2646785 | 11/1990 | France | 206/315.6 |

*Primary Examiner*—Sue A. Weaver

[57] ABSTRACT

A golf club security device (10) includes at least a pair of plates (12) (14) which are rotatable with respect to one another. The security device is disposed and affixed inside a golf bag. Each of said plates has a plurality of vias or holes formed therein. When disposed in a first condition, the holes of the first and second plate align so that the shaft of a golf club may be inserted thereinto. Subsequently, in a second condition, the plates rotate with respect to one another about a central axis, locking the golf club inside the golf bag.

10 Claims, 4 Drawing Sheets

20
50
52
54
12
56
14
58
60
62
66
64
16
70
68
72
84
18
26
80
28
82
86
24
40
22
38
30
32
10
36
42

GOLF BAG SECURITY DEVICE

TECHNICAL FIELD

This invention relates in general to a security device for use in combination with a golf club bag. More particularly, the instant invention relates to a security device which may be mounted into a golf bag, and has an integral locking member.

BACKGROUND

It is an increasingly common occurrence that golf clubs are stolen out of golf bags left unattended at golf courses, and country clubs. As golf club prices continue to rise to unprecedented levels, so too does the market for black market golf clubs. Over the course of time, a typical golfer will purchase a set of golf clubs, plus several specialty clubs, such as wedges, and fairway woods. Accordingly, the value of a typical golf bag can easily top $1,000.00. However, most golfers routinely leave their golf bag unattended for extended periods of time while in the pro shop, club house or locker room. The hazards of golf club theft have been discussed extensively in the recent press. Articles such as *Golf's New Unexpected Hazard*, Detroit News, Jul. 9, 1995; and *Thou Shalt Not Steal*, Golf Shop Operations, January 1994, discuss in great detail the growing loss to the industry, and to individuals. These articles note that current golf club protection devices are generally ineffective against most thefts.

Indeed, many types of golf bag protection devices are known in the industry. Some of these are illustrated in, for example, U.S. Pat. Nos. 4,863,019 and D336,603. Each of these references illustrate devices which include two or more arms or fingers through which golf clubs protrude. Thereafter, the arms are closed at one end and secured with a conventional key or combination lock. Neither of these devices is integrally formed with the golf bag, nor are the locks integral to the security mechanisms. These features can compromise the effectiveness of the security device. Other devices are illustrated in, for example, U.S. Pat. Nos. 5,004,100, 5,028,909, and 5,041,815. Each of these devices, however, suffer from a number of limitations which may limit their effectiveness as security devices.

Accordingly, there exists a need for golf club security devices which truly provide protection against club theft. The device should be integrally formed or formable with the golf bag so as to prevent easy circumvention of the security feature. Moreover, the device should have an integral lock to provide enhanced safety.

SUMMARY OF THE INVENTION

Briefly, according to the invention, there is provided a golf club security device comprising at least first and second plate members, each plate member having a plurality of vias formed therethrough. The plate members are disposed adjacent one another and rotatable with respect to one another about a central axis of said two plate members. The security device is disposed and affixed inside a golf bag. When in a first condition, the holes of the first and second plate align so that the shaft of a golf club may be inserted thereinto. Subsequently, in a second condition, the plates rotate with respect to one another about a central axis, locking the golf club inside the golf bag.

In a preferred embodiment of the device, the golf club security device is integrally mounted in the open end of a golf bag. The device has an annular collar member mountable inside a golf bag. Specifically, the collar member is affixed along the inner diameter of the golf bag. A first plate member having a plurality of vias formed therein is attached to said annular collar member, and disposed in a plane horizontal to said open end of said golf bag. A second plate member having a plurality of vias formed therein is disposed immediately subjacent said first plate member, and slidably rotatable with respect to said first plate member. A third plate member having a plurality of vias formed therein may also be disposed immediately subjacent said second plate member, and slidably rotatable with respect to said first and said second plate members.

DETAILED DESCRIPTION OF THE PREFERRED EMBODIMENT

Figure 1:
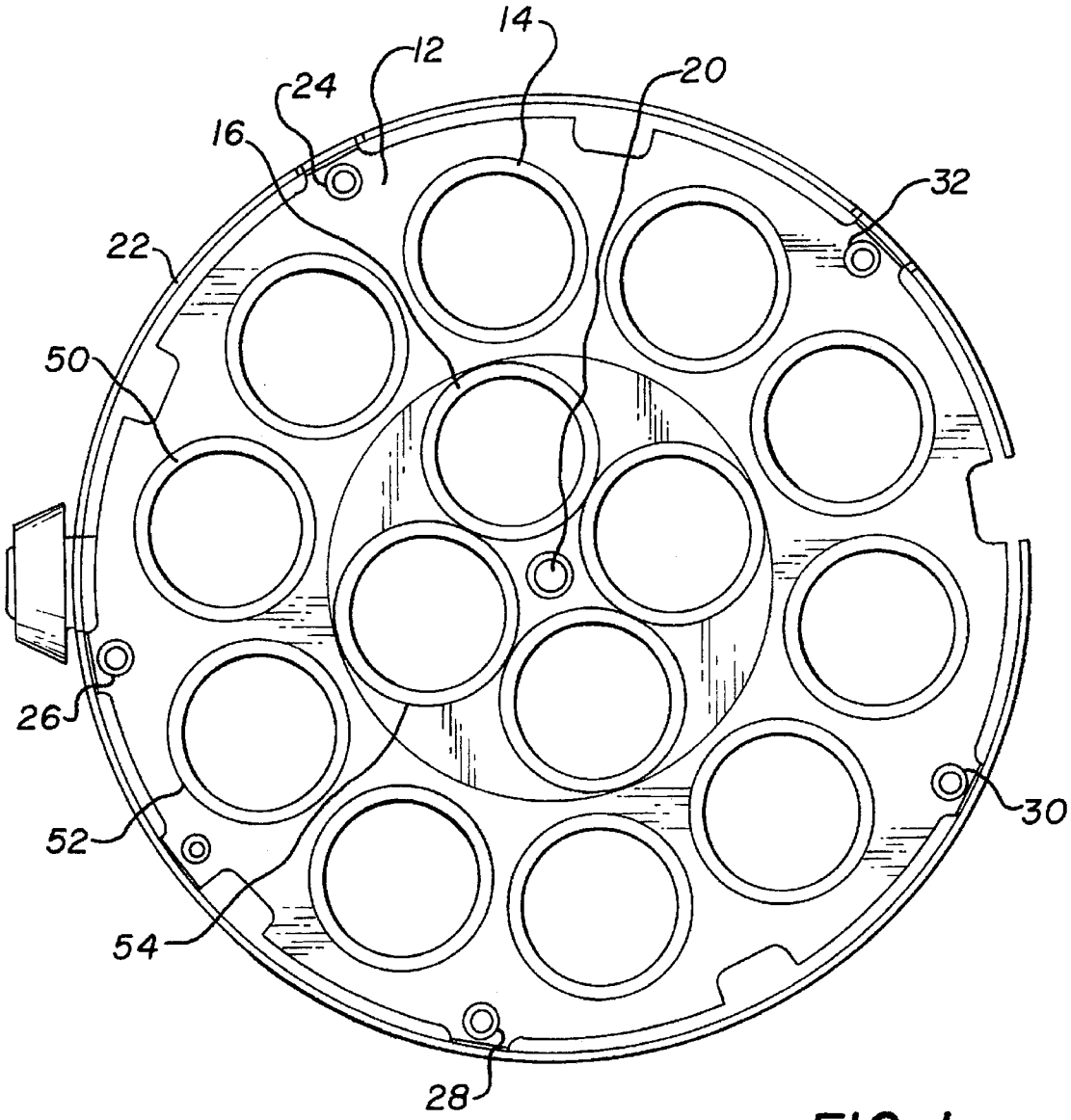
FIG. 1 is a top plan view of a golf club security device in accordance with the instant invention.

While the specification concludes with claims defining the features of the invention that are regarded as novel, it is believed that the invention will be better understood from a consideration of the following description in conjunction with the drawing figures, in which like reference numerals are carried forward.

Figure 2:
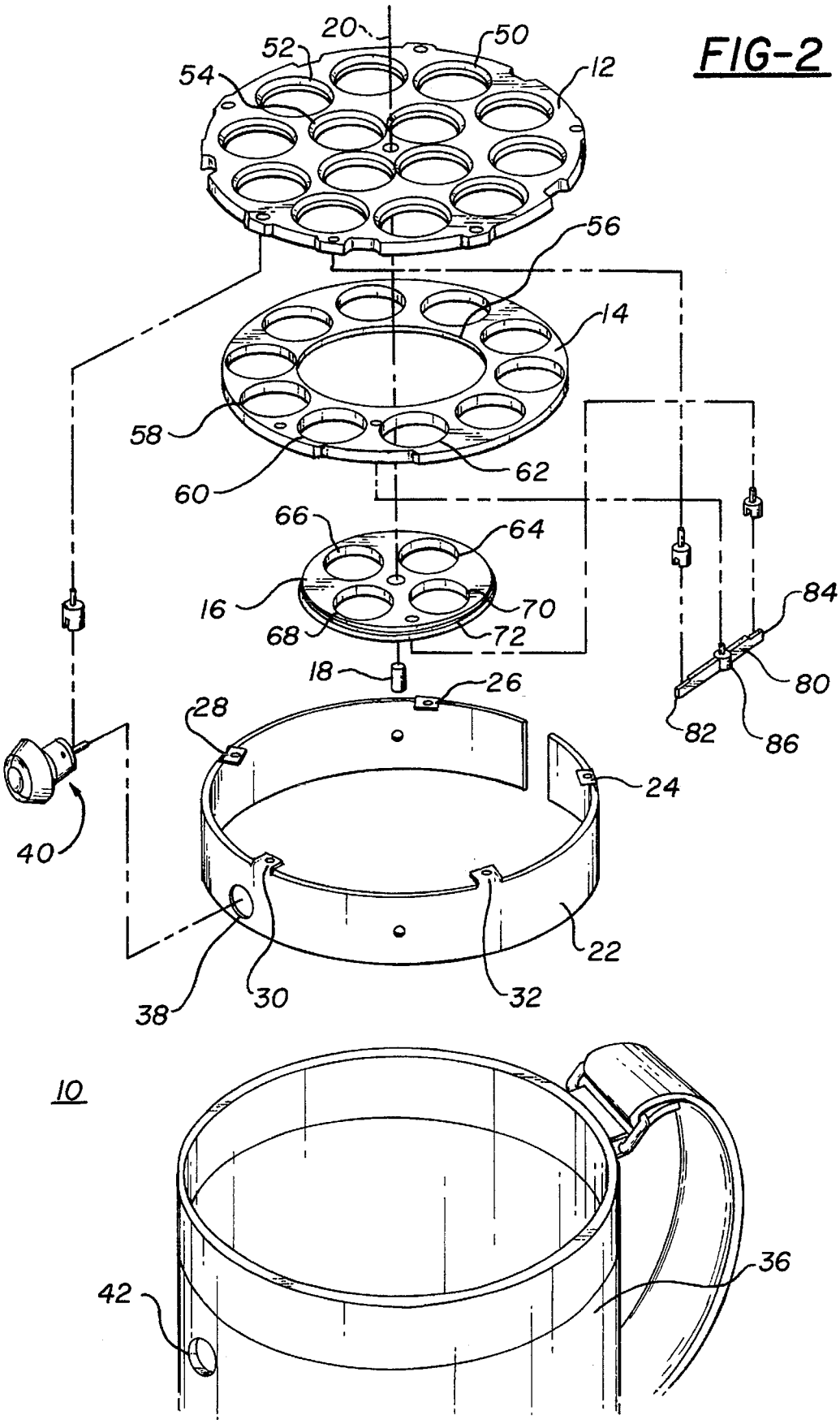
FIG. 2 is an exploded perspective view of a golf club security device in accordance with the instant invention.

Referring now to FIGS. 1 and 2, there is illustrated therein a top plan view and an exploded perspective view respectively of a golf club security device 10 in accordance with the instant invention. The device 10 includes first, second and third plate members 12, 14, and 16 respectively, each of which will be illustrated in greater detail hereinbelow. Also, as will be shown in detail below, second and third plates 14 and 16 are attached to first plate 12 by a pin member 18 along the central axis 20 of the plate members.

The first plate member 12 is affixed to an annular collar member 22 at one end thereof. The annular collar may include a plurality of contact points 24, 26, 28, 30 and 32 for attaching to said first plate member. The annular collar 22 is sized and shaped so as to fit in the open end of a conventional golf bag 36. Indeed, it is contemplated that the design described herein will be ideally suited for use with any golf bag, and particularly with commonly used circular golf bags. Accordingly, the plate members are arranged in a plane that is horizontal with respect to the open end of the golf bag. The annular collar may also have a hole 38 formed therein for accommodating a locking device 40 (described below). The golf bag may therefore also have a hole 42 for accommodating said locking device.

Each of said plate members 12, 14, and 16 has a plurality of vias or holes formed therethrough. For example, first plate member includes fourteen (14) vias such as vias 50, 52 and 54. Four of the vias are arranged immediately about the central axis 20 of the first plate member, and an additional ten vias are arranged around the periphery of the first plate member. Second plate member 14 has eleven (11) vias; a relatively large via 56 located at the central axis 20, and ten additional vias such as 58, 60 and 62 located around the periphery of the second plate member. The third plate member 16 includes four vias 64, 66, 68, and 70. The third plate member also includes a ridge 72 formed in the peripheral edge of the plate. The ridge is adapted to engage central via 56 of second plate member 14. Thus pin 18 affixes third plate member 16 to first plate member 12, with the second plate member 14 sandwiched therebetween.

As illustrated herein, the device includes a total of fourteen continuous vias in the stacked structure of plates 12, 14 and 16. This number was chosen as it represents the typical number of golf clubs in an average set. The invention however is not so limited. Any number of vias may be chosen without departing from the spirit of scope of the invention. Likewise, the number of vias formed in the second and third plate members, exclusive of the large central via in the second plate member, need only add up to the total number of vias in the first plate member. Thus, the ten vias located around the periphery of the second plate member correspond to the ten vias formed through the periphery of the first plate member, while the four vias formed in the third plate member correspond to the four central vias in the first plate member.

Figure 3:
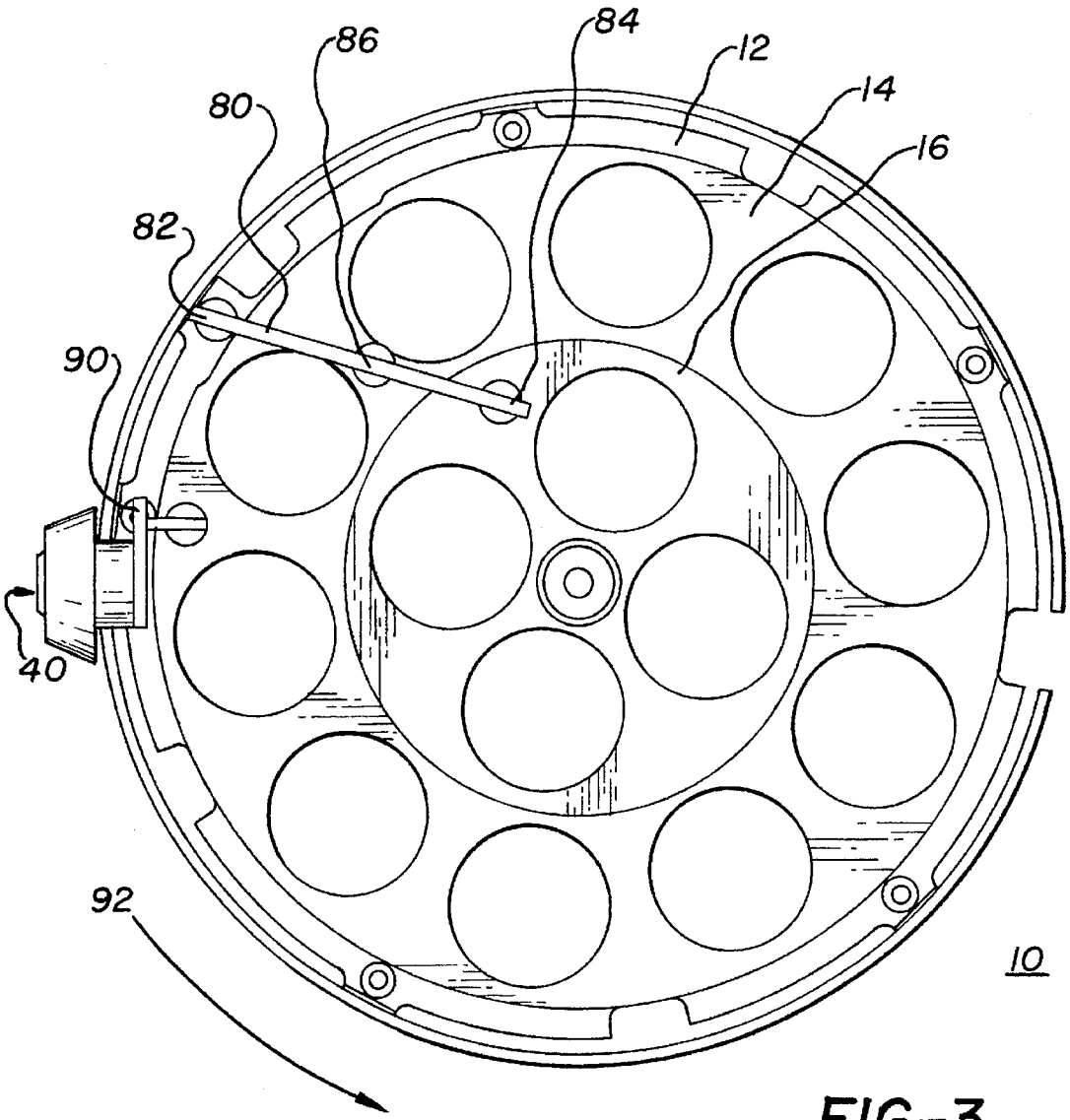
FIG. 3 is a bottom plan view of a golf club security device in the open configuration, and in accordance with the instant invention.

Referring now to FIGS. 2 and 3, the golf club security device further includes a lever 80 having a first end thereof 82 attached to the first plate member 12, a second end thereof 84 attached to the third plate member 16, and a central portion 86 attached to the second plate member 14. It may also be appreciated from FIG. 3 that locking device 40 also includes a lever 90 attached to the second plate member, and which rotates second plate member 14 in the direction of arrow 92 when a key (not shown) is inserted in the locking device, and turned. As the second plate member 14 rotates, lever 80 also rotates third plate member 16 in the same direction as arrow 92. As the third plate member need not travel as far as the second plate member, the connection points of the lever 80 are such that both the second and third plates travel only far enough to substantially close the vias in the first plate member. Accordingly, locking device 40 may be any one of a number of devices well known in the field.

Figure 4:
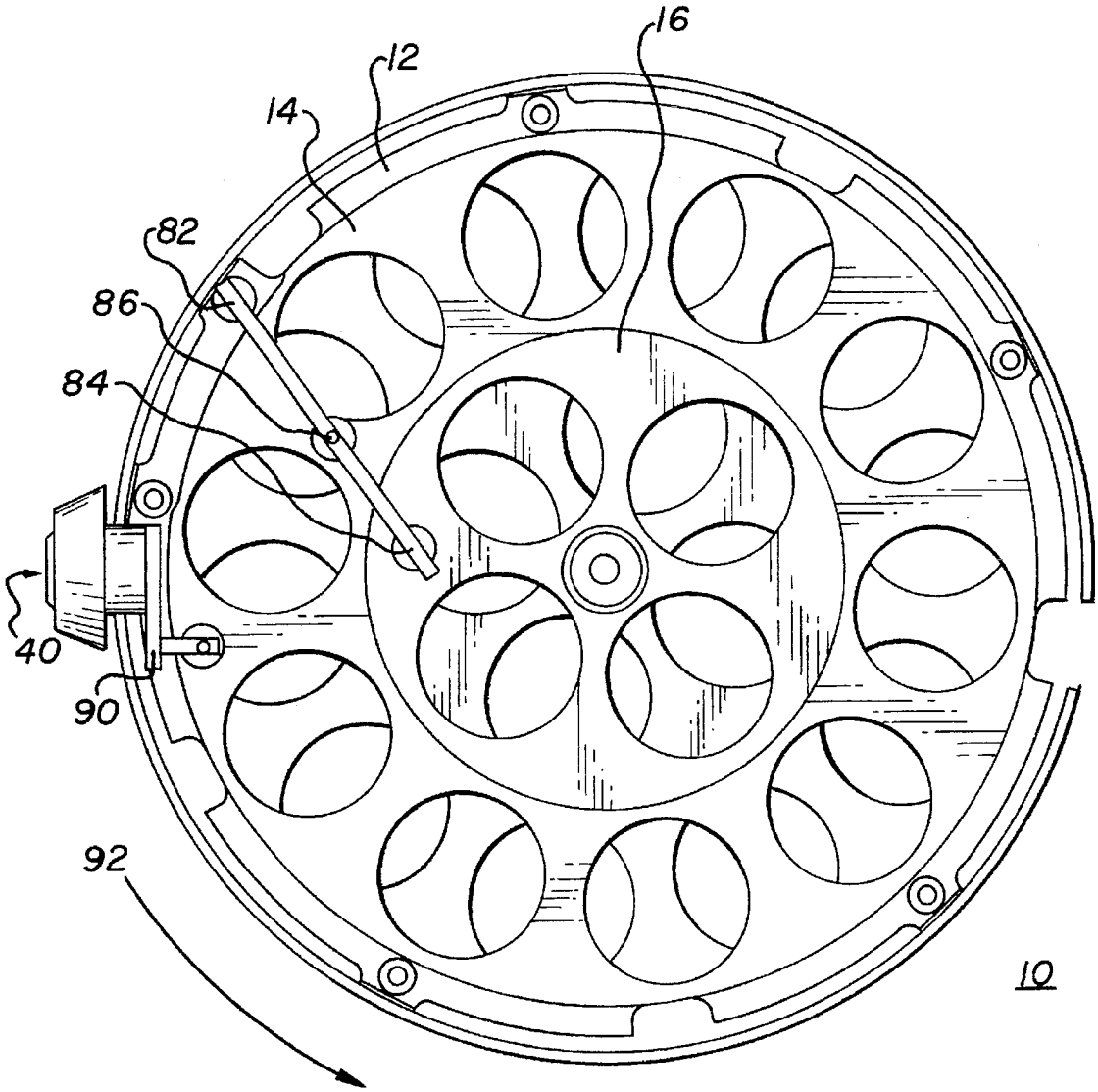
FIG. 4 is a bottom plan view of a golf club security device in the closed configuration, and in accordance with the instant invention.

In operation, when the first, second and third plate members are all in a first condition, as illustrated in FIG. 3, all of the vias line up and are open. Thus, the shaft of a golf club can be inserted through the open vias and into the golf bag. By engaging the locking device, second and third plate members rotate relative to the first plate member, thus closing the vias as illustrated in FIG. 4, and engaging the inserted golf club between either the first and second plate members or the first and third plate members, depending upon which via is used.

In order to prevent damage to a golf club in the bag, the plates may be fabricated of materials that securely engage the club shaft, while not damaging the material, such as graphite, from which the shaft is made. In this regard, the plates may be made of plastic or polymeric materials, such as Delrin®, a polymeric material. Using plastics or polymers has the additional advantage of reducing the weight of the device, an important consideration when remembering that the golf bag must regularly be carried by the golfer. Similarly, the annular ring may be fabricated of strong, yet light materials, examples of which include aluminum. Further, the periphery of the vias may include padding or other protection so as to prevent scratching or other damage to the shaft of the inserted golf club.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A golf club security device integrally mounted in a golf bag having an opened and a closed end, said device comprising:

an annular collar member mountable inside a golf bag;

a first plate member having a plurality of vias formed therein attached to said annular collar member, and disposed in a plane horizontal to said opened end of said golf bag;

a second plate member having a plurality of vias formed therein disposed immediately subjacent said first plate member, and slidably rotatable with respect to said first plate member;

a third plate member having a plurality of vias formed therein disposed immediately subjacent said second plate member, and slidably rotatable with respect to said first and said second plate members, wherein said third plate member fits inside a central via formed through said second plate member and said third plate member urges said second plate member against said first plate member, and wherein said third plate member and said first plate member are attached by a pin at the central axis of each; and a lever attached to said annular collar and said second and third plate members for rotating said second and third plate members relative to said first plate member;

wherein a golf club shaft extending through a via in said first and second or third plate members is locked in place as said second and third plate members rotate relative to said first plate member.

2. A golf club security device as in claim 1, further comprising a lockable device for effecting rotation of said second and third plate members relative to said first plate member.

3. A golf club security device as in claim 2, wherein said lockable device rotates said second plate member, and said lever rotates said third plate member.

4. A golf bag having an open and a dosed end, wherein a locking device for securing a golf club in said golf bag is mounted in said open end, said device comprises first, second and third plate members, each plate member having a plurality of vias formed therethrough, wherein said third plate member fits inside a central via formed through said second plate member and said third plate member urges said second plate member against said first plate member, and wherein said third plate member and said first plate member are attached by a pin at the central axis of each, said second and third plate members being connected by a lever for rotating said second and third plate members relative to said first plate member.

5. A golf bag as in claim 4, further comprising a lockable device for moving one end of said lever, effecting rotation of said second and third plate members relative to said first plate member.

6. A golf bag as in claim 5, wherein said lockable device rotates said second plate member, and said lever rotates said third plate member.

7. A golf club security device comprising first, second and third plate members, each plate member having a plurality of vias formed therethrough, wherein said third plate member fits inside a central via formed through said second plate member and said third plate member urges said second plate member against said first plate member, and wherein said third plate member and said first plate member are attached by a pin at the central axis of each, said second and third plate members being connected by a lever for rotating said second and third plate members relative to said first plate member; wherein a golf club shaft extending through a via in said first and second or third plate members is locked in place as said second and third plate members rotate relative to said first plate member.

8. A golf club security device as in claim 7, wherein said first plate member is operatively affixed to an annular collar mountable in the open end of a golf bag.

9. A golf club security device as in claim 7, comprising a lockable device for moving one end of said lever, and effecting rotation of said second and third plate members relative to said first plate member.

10. A golf club security device as in claim 9, wherein said lockable device rotates said second plate member, and said lever rotates said third plate member.

* * * * *